US009599398B2

(12) United States Patent
Grunewald

(10) Patent No.: US 9,599,398 B2
(45) Date of Patent: Mar. 21, 2017

(54) CONDENSATION DRYER

(71) Applicant: Eichenauer Heizelemente GmbH & Co. KG, Kandel (DE)

(72) Inventor: Jerome Grunewald, Silz (DE)

(73) Assignee: Eichenauer Heizelemente GmbH & Co. KG, Kandel (DE)

( * ) Notice: Subject to any disclaimer, the term of this patent is extended or adjusted under 35 U.S.C. 154(b) by 687 days.

(21) Appl. No.: 13/857,502

(22) Filed: Apr. 5, 2013

(65) Prior Publication Data

US 2013/0269207 A1 Oct. 17, 2013

(30) Foreign Application Priority Data

Apr. 13, 2012 (DE) ..... 10 2012 007 275

(51) Int. Cl.

| | |
|---|---|
| ***F26B 21/00*** | (2006.01) |
| ***A47L 15/00*** | (2006.01) |
| ***A47L 15/48*** | (2006.01) |
| ***D06F 58/24*** | (2006.01) |
| ***D06F 58/28*** | (2006.01) |
| *D06F 58/02* | (2006.01) |
| *D06F 58/20* | (2006.01) |

(52) U.S. Cl.

CPC ..... *F26B 21/001* (2013.01); *A47L 15/0034* (2013.01); *A47L 15/481* (2013.01); *D06F 58/24* (2013.01); *D06F 58/28* (2013.01); *A47L 2501/10* (2013.01); *D06F 58/02* (2013.01); *D06F 58/206* (2013.01); *D06F 2058/2864* (2013.01)

(58) Field of Classification Search

CPC .. F26B 21/001; A47L 15/0034; A47L 15/481; A47L 2501/10; D06F 58/24; D06F 58/28; D06F 58/02; D06F 58/206; D06F 2058/2864

See application file for complete search history.

(56) References Cited

U.S. PATENT DOCUMENTS

| | | | | |
|---|---|---|---|---|
| 3,032,887 A * | 5/1962 | Whyte | ..... | D06F 58/02 34/524 |
| 7,914,607 B2 | 3/2011 | Moschutz et al. | | |
| 2010/0139111 A1* | 6/2010 | Favret | ..... | D06F 58/24 34/76 |

FOREIGN PATENT DOCUMENTS

| | | | | |
|---|---|---|---|---|
| DE | 4330456 C1 * | 3/1995 | ..... | D06F 58/20 |
| DE | 69525350 | 2/2002 | | |
| DE | 10356786 | 7/2007 | | |
| DE | 102005062942 | 7/2007 | | |
| DE | 102005062943 | 7/2007 | | |
| JP | 2011072589 A * | 4/2011 | | |
| NL | EP 0777998 A1 * | 6/1997 | ..... | B01D 53/261 |

* cited by examiner

*Primary Examiner* — Jiping Lu

(74) *Attorney, Agent, or Firm* — Volpe and Koenig, P.C.

(57) ABSTRACT

A condensation dryer, in particular a tumble dryer, having a heat exchanger (2). In the heat exchanger (2) moisture, which has been absorbed in a drying chamber (1), is separated from an air circuit (3). The condensation dryer includes a sorption unit (5). The sorption unit (5) is connectable to a liquid reservoir (7). Between the liquid reservoir (7) and the sorption unit (5) a cooling fluid flow (4) can be generated. The cooling fluid flow (4) passes through the heat exchanger (2).

13 Claims, 2 Drawing Sheets

CONDENSATION DRYER

CROSS-REFERENCE TO RELATED APPLICATIONS

The following documents are incorporated herein by reference as if fully set forth: German Patent Application No.: DE 102012007275.9, filed Apr. 13, 2012.

BACKGROUND

The invention relates to a condensation dryer, in particular a tumble dryer, comprising a heat exchanger for the condensation of moisture from an air circuit, which has been absorbed in a drying chamber and a method for operating a condensation dryer.

One differentiates on the one side traditional dryers, where the resulting hot humid air is usually vented outside, and on the other side condensation dryers. The invention relates to a condensation dryer, in which air is located in a closed air circuit within the dryer. In this closed air circulation, process air is heated in a first step. The dry warm process air passes through a drying chamber. The drying chamber is usually performed as a drum. The dry warm process air passes through the wet laundry and absorbs humidity.

The moisture-laden process air flows from the drying chamber into a heat exchanger for the condensation of moisture from the air circuit. This heat exchanger is usually located under the drum and is sometimes called a condenser. The heat exchanger has the task to condense the moisture from the closed "loop" of circulating air. Therefore the hot humid process air is cooled down.

In conventional condensation dryers a fan, which is coupled to the drum motor, promotes the movement of cool ambient fresh air through the heat exchanger. The cool fresh air, which is called "outside loop", is separated from the closed air circulation of the process air, which is called "inside loop", by heat-transferring walls. Heat exchangers of this category are also known as recuperators. The "inside loop" of air is sealed from the outside environment. The flow of cool "outside" fresh air is directed generally transversely to the flow of the "inside" process air. Such a flow arrangement is also known as cross-flow.

In the heat exchanger, the air is cooled below the dew point and moisture condenses from the process air. The fluid accumulates in a downstream bin. The condensed water is conveyed via a cyclically operating pump into a container, which is often mounted adjacent to the operating unit. The container has to be emptied regularly. After the deposition of the moisture the process air is reheated and recycled to the drying chamber.

DE 695 25 350 T2 discloses a condensation dryer, which comprises a zeolite adsorption system. The system consists of an adsorber-desorber, which contains zeolite as a solid adsorbent and an evaporator-condenser, which contains water. This zeolite adsorption system is located after a heat exchanger, which condenses from an air circuit. The condensation efficiency of the heat exchanger is not improved in this condensation dryer.

DE 103 56 786 A1 discloses a process for drying in a domestic appliance. The household appliance comprises a container with water and a sorber with reversibly dehydratable material such as zeolite. In the sorber an electrical heating element is present, which can heat the reversibly dehydratable material for desorption. The sorber and the container are connected via a pipe. Both the container and the sorber are positioned in a closed air circuit of the domestic appliance. In difference to the invention this household appliance does not have a heat exchanger for the condensation of moisture from the process air flow.

SUMMARY

The object of the invention is to improve the efficiency of condensation of moisture in a heat exchanger of a condensation dryer. Due to the higher efficiency of the heat exchanger the drying time shall be reduced. Also the total energy shall be reduced, which is required for the drying process.

According to the present invention this object is achieved by a condensation dryer with one or more features as described below and in the claims.

The condensation dryer comprises a sorption unit, which is connectable with a liquid reservoir for generating a cooling fluid flow between the liquid reservoir and the sorption unit through the heat exchanger. Preferably the liquid reservoir is a container with a liquid.

According to the invention, the heat exchanger is not cooled by ambient fresh air but by a fluid stream, which is generated between a liquid reservoir and a sorption unit.

The term "fluid" is to be understood to include gases, vapors, liquids or a mixture of these. For example it can be a water vapor—air mixture. Particularly favorable proves a cooling fluid stream of pure water vapor.

The sorption unit comprises a solid compound, which can adsorb the fluid. Such solids are referred to as adsorbents. Volatile substances as the fluid, which adsorb at the solid, are referred to as adsorbate.

Preferably the solid compound is a zeolite. Zeolites are crystalline aluminosilicates, which occur in numerous modifications in nature, but can also be produced synthetically. Preferably zeolite granulate is used in the sorption unit to ensure a better heat and mass transfer, compared to the use of zeolite powder.

The term "sorption" is to be understood to comprise adsorption and desorption. Adsorption is the enrichment of substances from gases or liquids at the surface of a solid body, generally at the interface between two phases. Desorption is the separation of the fluid from a solid surface. Desorption is the reverse process of adsorption. Adsorption and desorption are surface phenomena.

For generating the cooling fluid flow through the heat exchanger a connection between the sorption unit and the liquid reservoir is opened. For this purpose a shutoff device can be opened, such as a valve or a slider. The sorption unit and the liquid container are preferably connected at least one hermetically sealed passage, which leads through the heat exchanger. The hermetically sealed passages can be designed as one or more pipes, as one or more hoses or as one or more channels, which lead through the heat exchanger.

The container may be formed of different materials and may have different shapes. The liquid in the container may also be stored in a medium, such as a porous solid, such as a sponge.

Liquid molecules accumulate in the gas phase above the liquid phase.

The liquid reservoir and the sorption unit are connected with at least one passage. Preferably this is a closed system. In a preferred embodiment of the invention, this system is largely free of air. The system is preferably evacuated of air in the production process of the condensation dryer.

Preferably the passages between the liquid reservoir and the sorption unit are first closed in an initial state.

Preferably there is no air above the fluid in the container. The space above the liquid is filled by liquid particles, which pass from the liquid phase into the gas phase. A vapor-liquid equilibrium sets in. The pressure in the gas space corresponds to the vapor pressure of the liquid. The vapor pressure or equilibrium vapor pressure is the pressure exerted by a vapor in thermodynamic equilibrium with its condensed phases at a given temperature in a closed system.

As for the liquid in the container water is particularly suitable. Preferably pure water vapor is present in the gas space of the closed liquid container-sorption unit-system.

After opening the connection between the sorption unit and the liquid container, fluid molecules, which are located in the gas phase, are adsorbed at the solid in the sorption unit. Therefore the pressure drops in the liquid container after opening the shutoff and liquid evaporates.

Due to evaporation heat, which is necessary for evaporation, the liquid cools down. Therefore a cold fluid stream is generated, which flows from the liquid container to the sorption unit. According to the invention this cool fluid stream is passed through the heat exchanger. In conventional condensation dryers only air flows through the heat exchanger. In the inventive device a cooler fluid stream flows through the heat exchanger. Because of the stronger cooling a higher proportion of moisture condenses from the air circuit. The heat exchanger of the inventive condensation dryer has a higher condensation efficiency compared to state of the art devices. Therefore the drying time is reduced because the recycled air is drier after the heat exchanger and can absorb more moisture from the laundry in the drying chamber per cycle.

Because of the adsorption of the fluid, the sorption unit heats up during this first phase. This heat is used for the heating of the air circuit.

In a variant of the invention the sorption unit is at least partially embedded in the air circuit. The sorption unit is passed by process air of the air circuit and heat is transferred from the heated sorption unit to the air circuit.

The process air can flow around the sorption unit during the adsorption phase. This is particularly advantageous because if the adsorbent has a low temperature it has a high adsorption capacity for the fluid.

It is also possible that air of the air circuit continues to flow around the sorption unit even after the adsorption phase has ended.

In another variant the first adsorption phase is performed first and only afterwards the sorption unit is passed by air.

In an alternative embodiment of the invention the sorption unit is embedded at least partially in a passage of a fresh airflow. During and/or after the adsorption phase a fresh air stream flows around the sorption unit and heats up. Afterwards this fresh airflow transfers the heat it has absorbed to the air circuit using a heat exchanger.

In a favorable variant of the invention the sorption unit and the liquid reservoir are connected with at least one additional hermetically sealed passage, which does not pass through the heat exchanger. Through this passage desorbed fluid is fed back into the liquid container during a second phase of the operation.

Before the beginning of this second phase, the connection between the sorption unit and the liquid container, which leads through the heat exchanger, is closed. Afterwards the second connection between the sorption unit and the liquid container, which does not pass through the heat exchanger, is opened.

Preferably the sorption unit comprises a heater. If the solid bed of the sorption unit is saturated with fluid, the heater is turned on. The desorption-phase starts. The fluid is released from the solid. The dissolved fluid vapor is led back through the second passage into the liquid container where it condenses. Passages can be designed as one or more pipes, as one or more tubes or as one or more channels.

Because of the condensation of fluid vapor in the liquid container, condensation heat is released. To use this condensation heat it proves to be particularly advantageous if the condensation dryer comprises a passage for a flow of fresh air. In this passage the liquid container is at least partially embedded. During and/or after the second phase a fresh air stream passes the liquid container and heats itself. Afterwards the air stream transfers the heat via a heat exchanger to the "closed loop" air circuit of the condensation dryer.

Preferably fresh air flows around the liquid container even during the desorption-phase. It is also possible that even after the desorption-phase has ended fresh air continues to flow around the liquid container.

In an alternative variant of the method a third phase follows the desorption phase. During this third phase connections between the sorption unit and the liquid container are closed and a fresh air stream passes the sorption unit and/or the liquid container. Absorbed heat is then transferred to the air circuit via a heat exchanger.

In the inventive process the switching on and off of the fresh air streams is preferably accomplished by a control system due to process data, which have been collected. For this reason the apparatus is preferably equipped with temperature sensors, which are connected to a control system. The control system switches the individual fans according to the temperature data.

Because of the above-described forms of energy recovery the total energy required is reduced in this inventive drying process.

The transfer of heat from the respective fresh air streams to the air circuit may be accomplished by means of one or more components. The components can be heat exchangers for example.

In a variant of the invention the cooling process of the condensing heat exchanger is carried out continuously with a plurality of sorption units and/or a plurality of liquid reservoirs. While one sorption unit is operated in adsorption mode, the second sorption unit operates in the desorption mode. Afterwards the operation modes are changed.

BRIEF DESCRIPTION OF THE DRAWINGS

Other features and advantages of the invention will become apparent from the description of embodiments with reference to drawings and from the drawings themselves.

In the drawings.

DETAILED DESCRIPTION OF THE PREFERRED EMBODIMENTS

Figure 1:
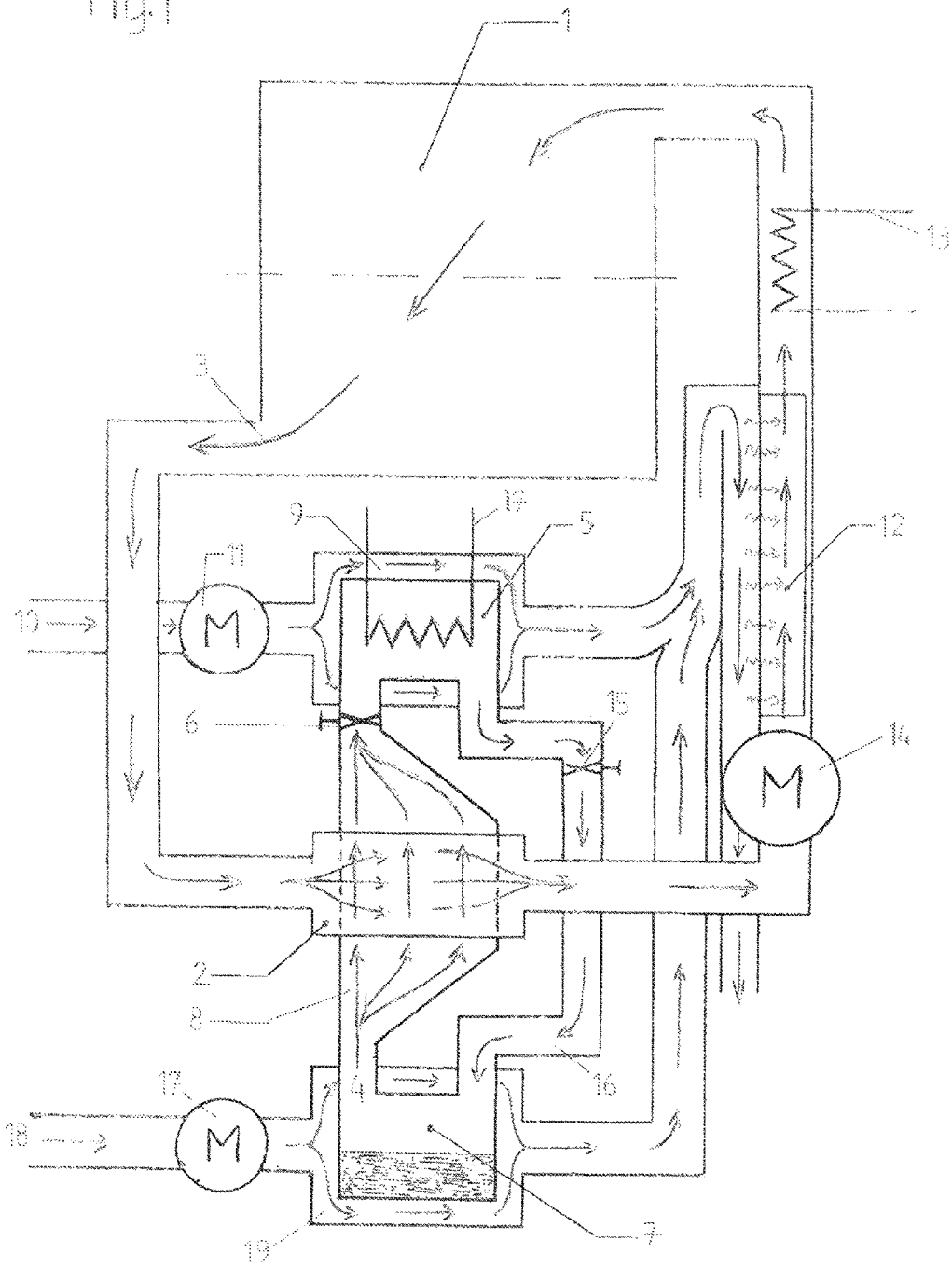
FIG. 1 shows a variant in which the sorption unit is arranged in a fresh-air passage.

FIG. 1 shows a condenser clothes dryer with a drying chamber 1. In this embodiment the drying chamber 1 is a rotatable drum. The drum rotates around a horizontal axis. Carriers are attached within the drum for moving the laundry during tumbling.

The warm dry process air flows through the damp laundry and becomes laden with moisture. The moist process air stream flows through heat exchanger 2. The process air flows in a closed air circuit 3.

In the heat exchanger 2 is a cross flow heat exchanger. It may be a conventional heat exchanger used in a conventional condenser dryer. But it proves to be particularly advantageous when a heat exchanger is used, which has a larger surface for the condensation of moisture from the air circuit 3, compared to conventional heat exchangers.

Upstream of the heat exchanger 2 a fluff filter is arranged. The moist process air of the air circuit 3 flows through the heat exchanger 2 and moisture is condensed from the process air. According to the invention the heat exchanger 2 is passed through by a cooling fluid flow 4. In the embodiment said cooling fluid flow 4 is of cold water vapor. In the heat exchanger 2 the cooling fluid flow is separated from the process air flow.

The cooling fluid flow 4 is generated with a sorption unit 5. In the embodiment the sorption unit 5 comprises a bed of solid adsorbent material. As adsorbent material a zeolite adsorbent is used. At the beginning of a first phase of operation a shutoff device 6 is opened. In the embodiment the shutoff device 6 is a valve.

In a liquid container 7 there is water. The liquid container 7 is connected to the sorption unit 5 via a hermetically sealed passage 8.

In the heat exchanger 2 the passage 8 divides into a plurality of channels. The channels for the fluid flow are perpendicular to the channels where the process air of the air circuit 3 flows through.

After flowing through the heat exchanger 2 the cooling fluid enters the sorption unit 5 where it is adsorbed at the zeolite bed. By the adsorption of water vapor at the zeolite solid material the sorption unit 5 heats up.

The sorption unit 5 is embedded in a passage 9 and is being passed by a fresh air flow 10. In the embodiment the passage 9 is an air duct. The fresh air flow 10 is generated by a fan 11.

When flowing around the sorption unit 5 the flow of fresh air 10 receives the heat liberated in the adsorption process and transfers the heat by means of a heat exchanger 12 to the process air of the air circuit 3.

Because of the cold water vapor, the heat exchanger 2 is cooled significantly more than in a conventional air-to-air operation. The condensation efficiency of the heat exchanger 2 is increased.

Downstream to the heat exchanger 2 the process air first flows through the heat exchanger 12 and then through a multistage electric heater 13. For energetic reasons the heater 13 should be constructed with multi-stages so only the lack of energy can be added to the process air stream before the process air stream flows back into the drying chamber 1.

The multi-stage heater 13 heats the process air flow, before it reenters the drying chamber 1. Because of the higher condensation level in the heat exchanger 2 the process air flow of the inventive device has a lower relative humidity. Therefore it can absorb more moisture when it passes through the laundry in the drying chamber 1. Therefore the drying time is reduced compared to conventional condensation dryers.

The process air flow in the air circuit 3 is maintained by means of a fan 14.

During a second phase of operation the shutoff device 6 is closed and the fan 11 is off. At the beginning of the second operating phase a further shutoff device 15 is opened. In the embodiment the shutoff device 15 is a valve.

The sorption unit 5 and the liquid container 7 are connected with another hermetically sealed passage 16, which does not pass through the heat exchanger 2. After opening of the further passage 16 a heater 17 is activated, which is part of the sorption unit 5. The heater 17 heats the zeolite material and fluid is desorbed. The desorbed water vapor flows through the passage 16 into the liquid container 7 and there it condenses. The condensation releases condensation heat.

Through the use of a fan 18 a further fresh air flow 18 is generated, which passes around the liquid container 7 and receives the liberated heat of condensation. The liquid container 7 is embedded into a further passage 19. In the embodiment the passage 19 is an air duct. The heated fresh air flow 18 flows through the heat exchanger 12. It transfers the heat to the process air of the air circuit 3. The fresh air flow 18 leaves the condensation dryer after the transfer of heat to the process air flow.

After the desorption phase the shutoff device 15 is closed and a fresh air flow 10 passes the sorption unit 5. A cooling phase can follow, during which the sorption unit 5 and/or the liquid container 7 can be cooled by fresh air flows 10 and/or 18. The heated fresh air flows 10, 18 transfer heat via the member 12, which is configured as a heat exchanger in the embodiment, to the process air of the air circuit 3 and afterwards they leave the condensation dryer.

Figure 2:
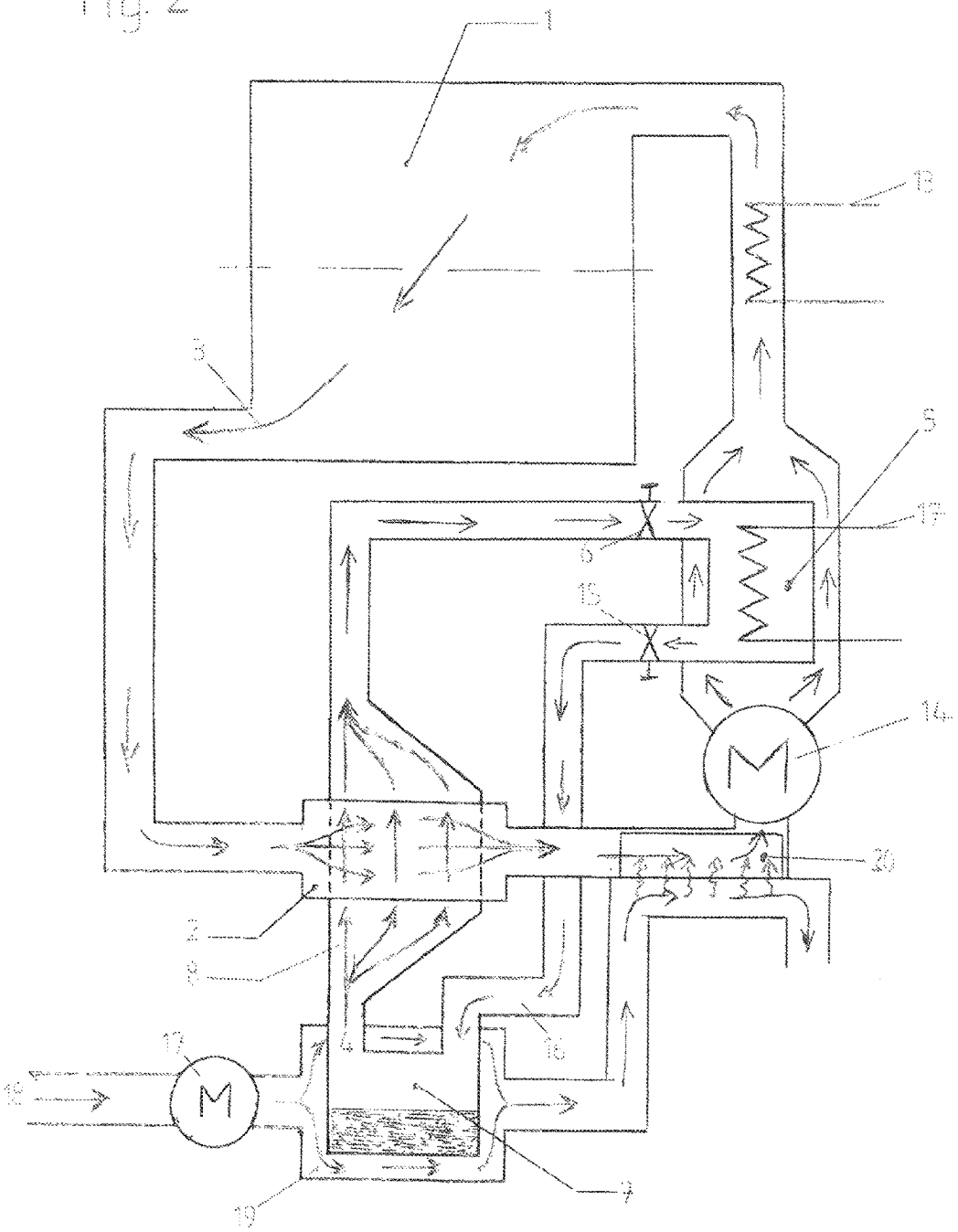
FIG. 2 shows a variant in which the sorption unit is arranged in the air circuit.

FIG. 2 shows a variant, in which the sorption unit 5 is embedded in the air circuit 3 of the process air flow. During the first operating phase, the adsorption phase, and during the second operating phase, the desorption phase, the sorption unit 5 transfers heat to the process air flow, which flows around the sorption unit 5 and is conveyed by the fan 14.

The fresh air stream 18, which receives the heat of condensation from the container 7 during the second phase of operation, transmits its heat by means of a heat transfer device 20 to the process air flow.

One operation cycle comprises a first and a second phase. During the drying process several cycles are carried out.

In a not illustrated embodiment of the invention the cooling process of the heat exchanger 2 is continuously operated with several sorption units 5. While one sorption unit 5 is in the adsorption mode, the second sorption unit 5 operates in desorption mode. Afterwards the modes change.

The invention claimed is:

1. A condensation dryer, comprising:

a heat exchanger (2) for the condensation of moisture from an air circuit (3), which has been absorbed in a drying chamber (1), and a sorption unit (5), connected to a liquid reservoir (7), generates a cooling fluid flow (4) from the liquid reservoir (7) to the sorption unit (5) that passes through the heat exchanger (2), wherein the air circuit (3) and the cooling fluid flow (4) are formed as two spatially separate systems, and the sorption unit (5) and the liquid reservoir (7) with at least one passage (8) connected therebetween form a closed system.

2. The condensation dryer according to claim 1, wherein the sorption unit (5) and the liquid reservoir (7) are connected via the at least one passage which comprises a hermetically sealed passage (8), which leads through the heat exchanger (2).

3. The condensation dryer according to claim 2, wherein the sorption unit (5) and the liquid reservoir (7) are connected with a further hermetically sealed passage (16), which does not pass through the heat exchanger (2).

4. The condensation dryer according to claim 1, wherein the condensation dryer comprises a passage (19) for a fresh air flow (18) in which the liquid reservoir (7) is embedded at least partly.

5. The condensation dryer according to claim 1, further comprising a passage (9) for a fresh air flow (10), in which the sorption unit (5) is embedded at least partly.

6. The condensation dryer according to claim 1, wherein the sorption unit (5) is embedded at least partly in the air circuit (3).

7. The condensation dryer according to claim 1, further comprising at least one component (12, 20) for transferring heat from at least a fresh air flow (10, 18) to the air circuit (3).

8. The condensation dryer of claim 1, wherein the condensation dryer is a tumble dryer.

9. A method of operating a condensation dryer according to claim 1, comprising the following steps:

in a first phase, opening a first connection (8) between the sorption unit (5) and the liquid reservoir (7), which leads through the heat exchanger (2)

generating a cooling fluid flow (4) from the liquid reservoir (7) to the sorption unit (5), which flows through the heat exchanger (2), in the heat exchanger (2), condensing moisture from an air circuit (3), which has been absorbed in a drying chamber (1), adsorption of fluid in the sorption unit (5), closing the first connection (8), and in a second phase opening a second connection (16) between the sorption unit (5) and the liquid reservoir (7), which does not pass through the heat exchanger (2), desorption of the fluid from the sorption unit (5), condensing the fluid in the liquid reservoir (7), and closing the second connection (16).

10. The method according to claim 9, wherein at least one of during or after the second phase, a flow of fresh air (18) passes the liquid reservoir (7) and is thereby heated, and transfers heat to the air circuit (3) afterwards.

11. The method according to claim 10, wherein at least one of during or after the first phase, a flow of fresh air (10) flows through the sorption (5) unit and is thereby heated, and transfers heat to the air circuit (3) afterwards.

12. The method according to claim 9, wherein after the second phase a flow of fresh air (10) passes the sorption (5) unit and is thereby heated, and transfers heat to the air circuit (3) afterwards.

13. The method according to claim 9, wherein during at least one of the first phase, the second phase, or after the second phase, the process air of the air circuit (3) passes through the sorption unit (5) and heat of the sorption unit (5) is transferred to the air circuit (3).

* * * * *